US009640103B2

(12) United States Patent
Park et al.

(10) Patent No.: US 9,640,103 B2
(45) Date of Patent: May 2, 2017

(54) APPARATUS FOR CONVERTING DATA AND DISPLAY APPARATUS USING THE SAME

(71) Applicant: LG Display Co., Ltd., Seoul (KR)

(72) Inventors: Yong Min Park, Goyang-si (KR); Dong Woo Kang, Goyang-si (KR); Tae Seong Han, Goyang-si (KR); Sung Jin Kim, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 299 days.

(21) Appl. No.: 14/444,957

(22) Filed: Jul. 28, 2014

(65) Prior Publication Data

US 2015/0035847 A1 Feb. 5, 2015

(30) Foreign Application Priority Data

Jul. 31, 2013 (KR) ..... 10-2013-0091150

(51) Int. Cl.
*G09G 5/02* (2006.01)
*G09G 3/20* (2006.01)
*G09G 3/3225* (2016.01)

(52) U.S. Cl.
CPC ..... *G09G 3/2003* (2013.01); *G09G 3/3225* (2013.01); *G09G 5/02* (2013.01); *G09G 2320/02* (2013.01); *G09G 2320/066* (2013.01); *G09G 2340/06* (2013.01)

(58) Field of Classification Search
CPC ..... G09G 3/2003; G09G 3/3225
See application file for complete search history.

(56) References Cited

U.S. PATENT DOCUMENTS 4,736,315 A * 4/1988 Ozaki ..... G06T 7/0002 345/582
5,144,684 A * 9/1992 Inada ..... H04N 1/4092 250/208.1
5,307,159 A * 4/1994 Hieda ..... H04N 9/045 348/235
5,363,209 A * 11/1994 Eschbach ..... H04N 1/58 358/445
5,367,629 A * 11/1994 Chu ..... G06T 9/008 375/240.12

(Continued)

FOREIGN PATENT DOCUMENTS

KR 10-2004-0085678 A 10/2004
KR 10-2013-0060476 A 6/2013

*Primary Examiner* — Devona Faulk
*Assistant Examiner* — Charles L Beard
(74) *Attorney, Agent, or Firm* — Fenwick & West LLP

(57) ABSTRACT

Disclosed is an apparatus for converting data capable of enhancing sharpness without deterioration of picture quality, and a display apparatus using the same, wherein the apparatus for converting data is provided in the display apparatus with a plurality of unit pixels, each unit pixel with red, green, blue and white sub-pixels, and the apparatus for converting data includes a 4-color data generator for generating 4-color data of red, green, blue and white colors for each unit pixel based on 3-color input data of red, green and blue colors of an input image; and a sharpness enhancer for enhancing sharpness of the input image by correcting white sub-pixel data of the unit pixel corresponding to an edge portion of the input image by a luminance variation of adjacent unit pixels based on white sub-pixel data for each unit pixel.

11 Claims, 8 Drawing Sheets

SM

| | | |
|---|---|---|
| -k(i-1, j-1) | -k(i, j-1) | -k(i+1, j-1) |
| -k(i-1, j) | k(i, j) | -k(i+1, j) |
| -k(i-1, j+1) | -k(i, j+1) | -k(i+1, j+1) |

EIM

| | | |
|---|---|---|
| -1/4 | 0 | -1/4 |
| 0 | 1 | 0 |
| -1/4 | 0 | -1/4 |

(56) References Cited

U.S. PATENT DOCUMENTS 5,418,574 A * 5/1995 Miyabata ..... H04N 9/646 348/253
H001506 H * 12/1995 Beretta ..... G06F 3/04845 345/549
5,606,630 A * 2/1997 Maeda ..... H04N 5/253 348/E5.049
5,715,070 A * 2/1998 Tone ..... G06T 1/20 358/1.15
5,754,697 A * 5/1998 Fu ..... G06T 9/007 358/1.9
5,896,489 A * 4/1999 Wada ..... G06K 15/1223 358/1.2
5,974,166 A * 10/1999 Ino ..... G06T 5/20 348/E5.081
6,064,494 A * 5/2000 Hirota ..... H04N 1/3935 358/1.9
6,285,798 B1 * 9/2001 Lee ..... G06T 5/004 382/260
6,415,062 B1 * 7/2002 Moed ..... G06K 9/342 382/209
6,507,670 B1 * 1/2003 Moed ..... G06K 9/38 358/464
6,542,187 B1 * 4/2003 Hamilton, Jr. ..... G06T 3/4007 348/234
6,583,897 B1 * 6/2003 Harrington ..... G06T 5/002 345/611
6,608,942 B1 * 8/2003 Le ..... G06T 5/002 382/199
6,697,107 B1 * 2/2004 Hamilton, Jr. ..... G06T 5/20 348/234
6,738,505 B1 * 5/2004 Prince ..... B23K 3/08 356/237.5
6,778,297 B1 * 8/2004 Fujiwara ..... G06K 9/00456 358/1.9
6,778,700 B2 * 8/2004 Karidi ..... G06K 9/00456 358/462
6,965,416 B2 * 11/2005 Tsuchiya ..... H04N 1/4092 348/606
7,002,627 B1 * 2/2006 Raffy ..... H04N 9/045 345/604
7,006,708 B1 * 2/2006 Nako ..... H04N 1/3878 382/217
7,672,484 B2 * 3/2010 Wiedemann ..... G06K 9/0063 382/103
7,990,444 B2 * 8/2011 Kudoh ..... H01L 27/14603 257/294
8,189,938 B2 * 5/2012 Hohenberger ..... H04N 5/23293 340/435
8,374,460 B2 * 2/2013 Hara ..... G06T 7/13 348/597
8,391,612 B2 * 3/2013 Natroshvili ..... G06T 7/13 382/103
8,411,991 B2 * 4/2013 Jo ..... G06T 5/002 345/611
8,417,064 B2 * 4/2013 Wakazono ..... G06T 5/008 382/167
8,457,426 B1 * 6/2013 Agrawal ..... H04N 1/64 382/237
8,547,472 B2 * 10/2013 Egawa ..... G06T 1/0007 348/272
8,818,095 B2 * 8/2014 Du ..... G06K 9/38 382/170
8,824,796 B2 * 9/2014 Du ..... H04N 1/403 382/170
8,830,398 B2 * 9/2014 Inoue ..... G06T 7/0002 348/14.12
9,025,903 B2 * 5/2015 Wada ..... G06T 5/002 382/254
2001/0020949 A1 * 9/2001 Gong ..... H04N 1/40062 345/593
2002/0006231 A1 * 1/2002 Jayant ..... G06T 3/403 382/266
2002/0008760 A1 * 1/2002 Nakamura ..... H04N 5/208 348/222.1
2002/0015165 A1 * 2/2002 Taka ..... G06K 15/129 358/1.9
2002/0181024 A1 * 12/2002 Morimoto ..... H04N 1/40075 358/3.15
2003/0085906 A1 * 5/2003 Elliott ..... G09G 3/20 345/613
2003/0206179 A1 * 11/2003 Deering ..... G06T 3/0081 345/589
2004/0001632 A1 * 1/2004 Adachi ..... G06K 9/6814 382/224
2004/0105107 A1 * 6/2004 Takahashi ..... H04N 1/00204 358/1.9
2004/0113875 A1 * 6/2004 Miller ..... G09G 3/3216 345/82
2004/0136586 A1 * 7/2004 Okamura ..... G06K 9/38 382/137
2004/0169807 A1 * 9/2004 Rho ..... G02F 1/133514 349/139
2004/0175030 A1 * 9/2004 Prince ..... B23K 1/0016 382/150
2004/0240748 A1 * 12/2004 Matsuda ..... H04N 9/3185 382/274
2005/0152613 A1 * 7/2005 Okutsu ..... G06T 5/00 382/254
2006/0044409 A1 * 3/2006 Aoki ..... H04N 9/646 348/222.1
2006/0098248 A1 * 5/2006 Suzuki ..... H04N 1/00002 358/496
2006/0140477 A1 * 6/2006 Kurumisawa ..... H04N 1/4074 382/169
2006/0147094 A1 * 7/2006 Yoo ..... G06K 9/00604 382/117
2006/0188147 A1 * 8/2006 Rai ..... H04N 9/045 382/162
2006/0274212 A1 * 12/2006 Lo ..... H04N 9/67 348/650
2007/0019243 A1 * 1/2007 Sato ..... H04N 1/38 358/3.27
2007/0025617 A1 * 2/2007 Dai ..... G06K 9/036 382/180
2007/0052818 A1 * 3/2007 Makino ..... G06T 7/0083 348/229.1
2007/0053586 A1 * 3/2007 Makino ..... G06T 7/0083 382/167
2007/0110303 A1 * 5/2007 Bhattacharjya ..... G09G 3/2003 382/166
2007/0206025 A1 * 9/2007 Oka ..... G06T 11/40 345/611
2007/0279372 A1 * 12/2007 Brown Elliott ..... G09G 3/3426 345/102
2008/0002998 A1 * 1/2008 Goto ..... H04N 1/40062 399/39
2008/0007752 A1 * 1/2008 Gandhi ..... H04N 1/58 358/1.9
2008/0042938 A1 * 2/2008 Cok ..... G09G 3/007 345/76
2008/0123153 A1 * 5/2008 Yamada ..... G06K 15/02 358/3.27
2008/0170124 A1 * 7/2008 Hatanaka ..... G06T 5/004 348/208.4
2008/0180556 A1 * 7/2008 Egawa ..... H04N 9/045 348/294
2008/0187235 A1 * 8/2008 Wakazono ..... H04N 5/243 382/255
2008/0199099 A1 * 8/2008 Michel ..... G06T 3/403 382/260
2008/0204577 A1 * 8/2008 Tsuruoka ..... G06K 9/4609 348/241
2008/0260282 A1 * 10/2008 Hasegawa ..... G06T 5/009 382/260
2009/0021792 A1 * 1/2009 Shin ..... H04N 1/40075 358/3.15
2009/0058873 A1 * 3/2009 Brown Elliott ..... G06T 5/009 345/589

(56) References Cited

U.S. PATENT DOCUMENTS

2009/0135207 A1* 5/2009 Tseng ..... G09G 3/3607 345/690
2009/0154800 A1* 6/2009 Kojima ..... H04N 19/176 382/165
2009/0179995 A1* 7/2009 Fukumoto ..... H04N 5/23248 348/208.6
2009/0226085 A1* 9/2009 Shiraishi ..... H04N 1/58 382/167
2009/0252434 A1* 10/2009 Zhou ..... G06K 9/38 382/276
2010/0013848 A1* 1/2010 Hekstra ..... G09G 3/20 345/589
2010/0014771 A1* 1/2010 Kim ..... G06T 5/20 382/263
2010/0026722 A1* 2/2010 Kondo ..... G09G 3/2007 345/660
2010/0123809 A1* 5/2010 Egawa ..... H04N 5/2257 348/280
2010/0157091 A1* 6/2010 Honda ..... H01L 27/14645 348/223.1
2010/0201719 A1* 8/2010 Kimura ..... G06T 1/00 345/690
2010/0231770 A1* 9/2010 Honda ..... H04N 9/045 348/308
2010/0245552 A1* 9/2010 Higuchi ..... A61B 1/00096 348/68
2010/0260401 A1* 10/2010 Spitzer ..... G06T 5/008 382/131
2010/0289962 A1* 11/2010 Kim ..... G09G 5/02 348/649
2010/0290710 A1* 11/2010 Gagvani ..... G06K 9/00543 382/224
2010/0310189 A1* 12/2010 Wakazono ..... G06T 5/008 382/258
2010/0315541 A1* 12/2010 Egawa ..... H01L 27/14621 348/294
2010/0328727 A1* 12/2010 Ohara ..... H04N 1/40062 358/3.01
2011/0043533 A1* 2/2011 Han ..... G09G 5/02 345/589
2011/0043553 A1* 2/2011 Brown Elliott ..... G09G 3/3406 345/694
2011/0050918 A1* 3/2011 Tachi ..... H04N 5/217 348/208.4
2011/0069209 A1* 3/2011 Kanemitsu ..... H04N 5/3675 348/246
2011/0069210 A1* 3/2011 Ogura ..... H04N 5/359 348/247
2011/0134292 A1* 6/2011 Hirai ..... H04N 9/646 348/280
2011/0150356 A1* 6/2011 Jo ..... G06T 5/002 382/269
2011/0199542 A1* 8/2011 Hirai ..... H04N 5/217 348/624
2012/0044369 A1* 2/2012 Irisawa ..... H04N 5/23248 348/208.4
2012/0057791 A1* 3/2012 Mitarai ..... G06K 9/4604 382/190
2012/0139974 A1* 6/2012 Sakai ..... G09G 3/3426 345/690
2012/0169792 A1* 7/2012 Yamashita ..... G02F 1/1336 345/690
2012/0188562 A1* 7/2012 Marumoto ..... G06K 15/1874 358/1.2
2012/0212638 A1* 8/2012 Schepelmann ..... A01D 34/008 348/222.1
2012/0219228 A1* 8/2012 Osako ..... G06K 9/3275 382/199
2012/0301046 A1* 11/2012 Wallace ..... G06T 5/003 382/263
2013/0044952 A1* 2/2013 Du ..... G06K 9/38 382/170
2013/0177235 A1* 7/2013 Meier ..... G06T 15/00 382/154
2013/0272605 A1* 10/2013 Saito ..... G06T 5/002 382/167
2013/0308018 A1* 11/2013 Sasaki ..... H04N 9/045 348/242
2013/0321574 A1* 12/2013 Zhang ..... H04N 19/597 348/43
2013/0321675 A1* 12/2013 Cote ..... H04N 9/64 348/242
2013/0322747 A1* 12/2013 Ozawa ..... H04N 1/58 382/164
2013/0322753 A1* 12/2013 Lim ..... G06T 5/001 382/167
2014/0118579 A1* 5/2014 Kim ..... H04N 9/045 348/242
2014/0241629 A1* 8/2014 Lerios ..... G06T 9/00 382/166
2014/0247984 A1* 9/2014 Sarkar ..... G06T 11/001 382/167
2014/0267442 A1* 9/2014 Lin ..... G09G 3/3208 345/690
2015/0030247 A1* 1/2015 Shu ..... H04N 1/58 382/167
2015/0085162 A1* 3/2015 Huang ..... H04N 9/3182 348/234
2015/0103108 A1* 4/2015 Seong ..... G09G 3/22 345/694
2015/0109356 A1* 4/2015 Yata ..... G09G 3/2003 345/691
2015/0317923 A1* 11/2015 Edmonds ..... G02B 5/208 40/541
2015/0356903 A1* 12/2015 Lee ..... G09G 3/2003 345/600
2015/0371605 A1* 12/2015 Wu ..... G09G 5/02 345/604
2016/0239942 A1* 8/2016 Usman ..... H04N 19/80
2017/0024006 A1* 1/2017 Kwon ..... G06F 3/013

* cited by examiner

SM

| | | |
|---|---|---|
| -k(i-1, j-1) | -k(i, j-1) | -k(i+1, j-1) |
| -k(i-1, j) | k(i, j) | -k(i+1, j) |
| -k(i-1, j+1) | -k(i, j+1) | -k(i+1, j+1) |

EIM

| | | |
|---|---|---|
| -1/4 | 0 | -1/4 |
| 0 | 1 | 0 |
| -1/4 | 0 | -1/4 |

APPARATUS FOR CONVERTING DATA AND DISPLAY APPARATUS USING THE SAME

CROSS REFERENCE TO RELATED APPLICATIONS

This application claims the benefit of the Korean Patent Application No. 10-2013-0091150 filed on Jul. 31, 2013, which is hereby incorporated by reference as if fully set forth herein.

BACKGROUND

Field of the Disclosure

Embodiments of the present invention relate to a display apparatus, and more particularly, to an apparatus for converting data which is capable of enhancing sharpness without deterioration of picture quality, and a display apparatus using the same.

Discussion of the Related Art

With the development of multi-media, a display apparatus such as television is becoming increasingly important. Thus, various display apparatus are widely used, for example, liquid crystal display apparatus, plasma display apparatus, organic light emitting display apparatus, and etc.

Generally, a display apparatus may include a plurality of unit pixels in accordance with a preset resolution, wherein each unit pixel may include red (R), green (G) and blue (B) sub-pixels.

In order to improve luminance for each unit pixel, recently, a display apparatus with a white (W) sub-pixel additionally provided to each unit pixel has been developed and utilized. This display apparatus converts 3-color input data of red, green and blue colors into 4-color data of red, green, blue and white colors, and displays the 4-color data.

In order to generate a clear image with good picture quality in the display apparatus with the white (W) sub-pixel, a sharpness enhancement technique is applied to emphasize an edge portion of an image. In this case, the display apparatus adopting the sharpness enhancement technique may include an apparatus for converting data which enhances sharpness for input image on the basis of 3-color input data, and converts the 3-color input data with the enhanced sharpness into 4-color data.

A related art apparatus for converting data converts 3-color input data (RGB) for each unit pixel into luminance components (Y) and chrominance components (CbCr) enhances sharpness of edge portion by analyzing the luminance components (Y) for each unit pixel and correcting luminance components (Y) of edge portion of input image, converts the luminance components (Y') and chrominance components (CbCr) into 3-color data (R'G'B'), converts the 3-color data (R'G'B') into RGBW 4-color data, and outputs the RGBW 4-color data.

However, the related art apparatus for converting data may have the following disadvantages.

First, since the change of luminance components (Y) in the edge portion of image makes the change of RGB 3-color data of the unit pixel, the change of sharpness becomes wide, and excessive sharpness enhancement may occur, which causes deterioration of picture quality. For example, if the sharpness correction process according to the related art is performed to image (a) of FIG. 1, a ringing artifact may be added to the image. That is, an edge portion of the image (a circumferential area of a black-colored letter) would look white, as shown in image (b) of FIG. 1, causing deterioration of picture quality.

Also, the related art apparatus for converting data needs the steps of converting the RGB 3-color data into the luminance components (Y) and re-converting the luminance components (Y) into the RGB 3-color data.

SUMMARY

Accordingly, embodiments of the present invention are directed to an apparatus for converting data and a display apparatus using the same that substantially alleviates one or more problems of the related art.

An aspect of other embodiments is directed to provide an apparatus for converting data which is capable of enhancing sharpness without deterioration of picture quality, and a display apparatus using the same.

Additional advantages and features of other embodiments will be set forth in part in the description which follows and in part will become apparent to those having ordinary skill in the art upon examination of the following. The objectives and other advantages of the various embodiments may be realized and attained by the structure particularly pointed out in the written description and claims hereof as well as the appended drawings.

To achieve these and other advantages, as embodied and broadly described herein, there is provided an apparatus for converting data in a display apparatus including a plurality of unit pixels, each unit pixel with red, green, blue and white sub-pixels, that may include a 4-color data generator for generating 4-color data of red, green, blue and white colors for each unit pixel on the basis of 3-color input data of red, green and blue colors of input image; and a sharpness enhancer for enhancing sharpness of the input image by correcting white data of the unit pixel corresponding to an edge portion by a luminance variation of adjacent unit pixels on the basis of white data for each unit pixel.

At this time, the sharpness enhancer shifts a matrix-configuration mask as a unit of each unit pixel, and corrects white data of each unit pixel corresponding to the center of the mask so as to enhance sharpness of the edge portion.

Also, the sharpness enhancer enhances the sharpness of edge portion by calculating an edge correction value for each unit pixel included in the mask through a convolution calculation of an edge correction coefficient set in each mask cell of the mask and white data of each unit pixel included in the mask; calculating a sharpness correction value by adding the edge correction values for the respective unit pixels included in the mask; and correcting the white data of the unit pixel corresponding to the central mask cell of the mask in accordance with the calculated sharpness correction value.

In addition, the apparatus for converting data may include a sharpness gain value generator for calculating a sharpness gain value for the input image on the basis of edge intensity for each unit pixel in accordance with the 3-color data of each unit pixel.

The sharpness gain value generator may include an edge intensity calculator for calculating the edge intensity for each unit pixel on the basis of 3-color data for each unit pixel; an edge distribution index calculator for calculating an edge distribution index for the input image on the basis of the total number of unit pixels and edge intensity for each unit pixel; and a gain value calculator for generating the sharpness gain value in accordance with the calculated edge distribution index.

The edge distribution index calculator calculates the edge distribution index by multiplying a ratio of the number of unit pixels whose edge intensity is more than a reference weak edge intensity and the number of unit pixels whose edge intensity is more than a minimum edge intensity and less than the reference weak edge intensity, and a rate of the number of unit pixels whose energy intensity is more than a reference edge intensity in the total number of unit pixels.

Also, the gain value calculator compares the edge distribution index with a preset edge distribution index threshold value, and calculates the sharpness gain value based on the comparison. If the edge distribution index is larger than the edge distribution index threshold value, the sharpness gain value is an initially-set gain value, and if the edge distribution index is the same as or smaller than the edge distribution index threshold value, the sharpness gain value is calculated by calculating a first value obtained by dividing the edge distribution index by the edge distribution index threshold value, calculating a second value through the use of exponentiation with a preset index value for the first value, and multiplying the initially-set gain value and the second value together.

The sharpness enhancer enhances the sharpness of edge portion by calculating an edge correction value for each unit pixel included in the mask through a convolution calculation of an edge correction coefficient set in each mask cell of the mask and white data of each unit pixel included in the mask; multiplying the sharpness gain value and the edge correction value for each unit pixel included in the mask; calculating a sharpness correction value by adding the edge correction values for the respective unit pixels included in the mask, wherein each edge correction value is obtained by applying the sharpness gain value thereto; and correcting the white data of the unit pixel corresponding to the central mask cell of the mask in accordance with the calculated sharpness correction value.

In another aspect of an embodiment, there is provided a display apparatus that may include a display panel including a plurality of unit pixels, each unit pixel with red, green, blue and white sub-pixels, formed in a pixel region defined by a plurality of data and scan lines crossing each other; a data converter for generating 4-color data of red, green, blue and white colors for each unit pixel on the basis of 3-color input data of red, green and blue colors of input image, and enhancing sharpness of the input image by correcting white data of the unit pixel corresponding to an edge portion by a luminance variation of adjacent unit pixels on the basis of white data for each unit pixel; and a panel driver for supplying a scan signal to the scan line, converting the 4-color data supplied from the data converter into a data voltage, and supplying the data voltage to the data line, wherein the data converter includes the above apparatus for converting data.

BRIEF DESCRIPTION OF THE DRAWINGS

The accompanying drawings, which are included to provide a further understanding of the various embodiments and are incorporated in and constitute a part of this application, illustrate the various embodiments and together with the description serve to explain the principle of the various embodiments. In the drawings.

DETAILED DESCRIPTION OF THE INVENTION

Reference will now be made in detail to the exemplary embodiments, examples of which are illustrated in the accompanying drawings. Wherever possible, the same reference numbers will be used throughout the drawings to refer to the same or like parts.

On explanation about the various embodiments, the following details about the terms should be understood.

The term of a singular expression should be understood to include a multiple expression as well as the singular expression if there is no specific definition in the context. If using the term such as "the first" or "the second", it is to separate any one element from other elements. Thus, a scope of claims is not limited by these terms. Also, it should be understood that the term such as "include" or "have" does not preclude existence or possibility of one or more features, numbers, steps, operations, elements, parts or their combinations. It should be understood that the term "at least one" includes all combinations related with any one item. For example, "at least one among a first element, a second element and a third element" may include all combinations of the two or more elements selected from the first, second and third elements as well as each element of the first, second and third elements.

Hereinafter, an apparatus for converting data, a display apparatus using the same and a driving method of the display apparatus will be described in detail with reference to the accompanying drawings.

Figure 1:
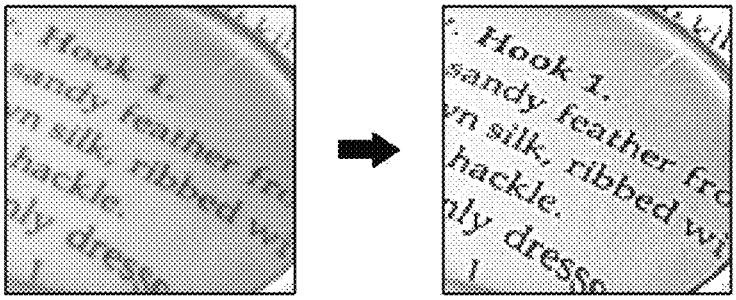
FIG. 1 Related Art
FIG. 1 illustrates an image applied with a related art data conversion method.
Figure 2:
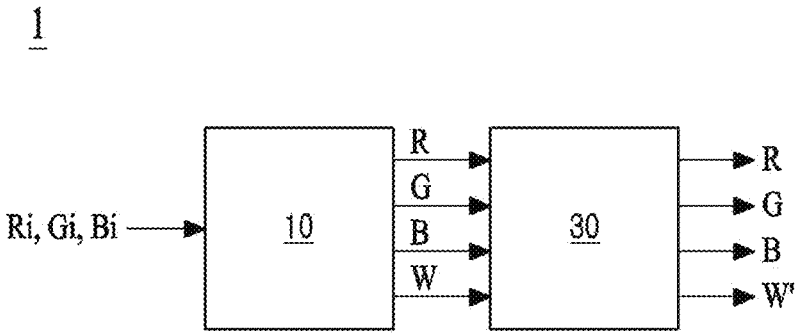
FIG. 2 is a block diagram illustrating an apparatus for converting data, according to one embodiment.

FIG. 2 is a block diagram illustrating an apparatus for converting data according to one embodiment.

Referring to FIG. 2, the apparatus for converting data 1 (hereinafter, referred to as 'data conversion apparatus') according to one embodiment generates 4-color data of red, green, blue and white colors (R, G, B, W) for each unit pixel comprising red, green, blue and white sub-pixels on the basis of 3-color input data (Ri, Gi, Bi) of input video frame which is input as a unit of frame; and corrects white data of unit pixel corresponding to an edge portion by a luminance variation of adjacent unit pixels on the basis of white data (W) for each unit pixel. To this end, the data conversion apparatus 1 according to the first embodiment of the present invention may include a 4-color data generator 10 and a sharpness enhancer 30

The 4-color data generator 10 generates the 4-color data of red, green, blue and white colors (R, G, B, W) for each unit pixel comprising the red, green, blue and white sub-pixels on the basis of 3-color input data (Ri, Gi, Bi) of input video frame which is input as a unit of frame. In detail, the 4-color data generator 10 extracts white data (W) from the 3-color input data (Ri, Gi, Bi) of red, green and blue colors every unit pixel; and generates the 4-color data of red, green, blue and white colors (R, G, B, W) for each unit pixel on the basis of extracted white data (W). For example, the 4-color data generator 10 may generate white data (W) by extracting a common grayscale value (or minimum grayscale value) from the 3-color input data (Ri, Gi, Bi) of red, green and blue colors; and generate red, green and blue data (R, G, B) by subtracting the white data (W) from each of red, green and blue input data (Ri, Gi, Bi). In another example, the 4-color data generator 10 may convert the 3-color input data (Ri, Gi, Bi) into the 4-color data (R, G, B, W) by a data conversion method preset based on the luminance characteristics of each unit pixel according to the characteristics of luminance of each sub-pixel and/or driving of each sub-pixel. In this case, the 4-color data generator 10 may convert the 3-color input data (Ri, Gi, Bi) into the 4-color data (R, G, B, W) by the conversion method disclosed in the Unexamined Publication Number P10-2013-0060476 or P10-2013-0030598 in the Korean Intellectual Property Office.

The sharpness enhancer 30 enhances sharpness of input image by correcting the white data (W) of the unit pixel corresponding to the edge portion by the luminance variation of adjacent unit pixels on the basis of white data (W) for each unit pixel supplied from the 4-color data generator 10 as a unit of frame. That is, the sharpness enhancer 30 shifts a mask by each unit pixel on the basis of white data (W) for each unit pixel and corrects the white data (W) for each unit pixel corresponding to the center of mask, to thereby enhance the sharpness of edge portion. The 4-color data (R, G, B, W') of red, green, blue and white colors for each unit pixel of which sharpness is enhanced in the edge portion as a unit of frame by the sharpness enhancer 30 is transmitted to a panel driver of a display apparatus in accordance with a predetermined data interface method.

The data conversion apparatus 1 according to the first embodiment of the present invention may further include a reverse-gamma corrector (not shown) and a gamma corrector (not shown).

The reverse-gamma corrector linearizes the 3-color input data (Ri, Gi, Bi) of red, green and blue colors of input video frame which is input as a unit of frame by a de-gamma correction, and supplies the linearized 3-color input data to the 4-color data generator 10. Accordingly, the 4-color data generator 10 converts the linearized 3-color input data, which is supplied as a unit of frame from the reverse-gamma corrector, into the 4-color data (R, G, B, W).

The gamma corrector gamma-corrects the 4-color data (R, G, B, W') whose sharpness is enhanced by the sharpness enhancer 30, to thereby realize a non-linearization. Accordingly, the 4-color data (R, G, B, W') of red, green, blue and white colors for each unit pixel which is non-linearized by the gamma corrector is transmitted to the panel driver of the display apparatus in accordance with the predetermined data interface method.

Figures 3, 4:
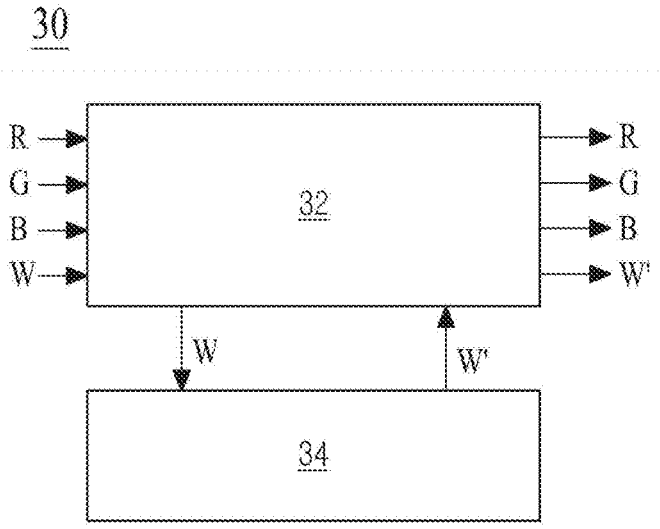
FIG. 3 is a block diagram illustrating a sharpness enhancer shown in FIG. 2.
FIG. 4 is a cross sectional view illustrating a sharpness correction mask used for a sharpness enhancer shown in FIG. 2.
Figure 5:
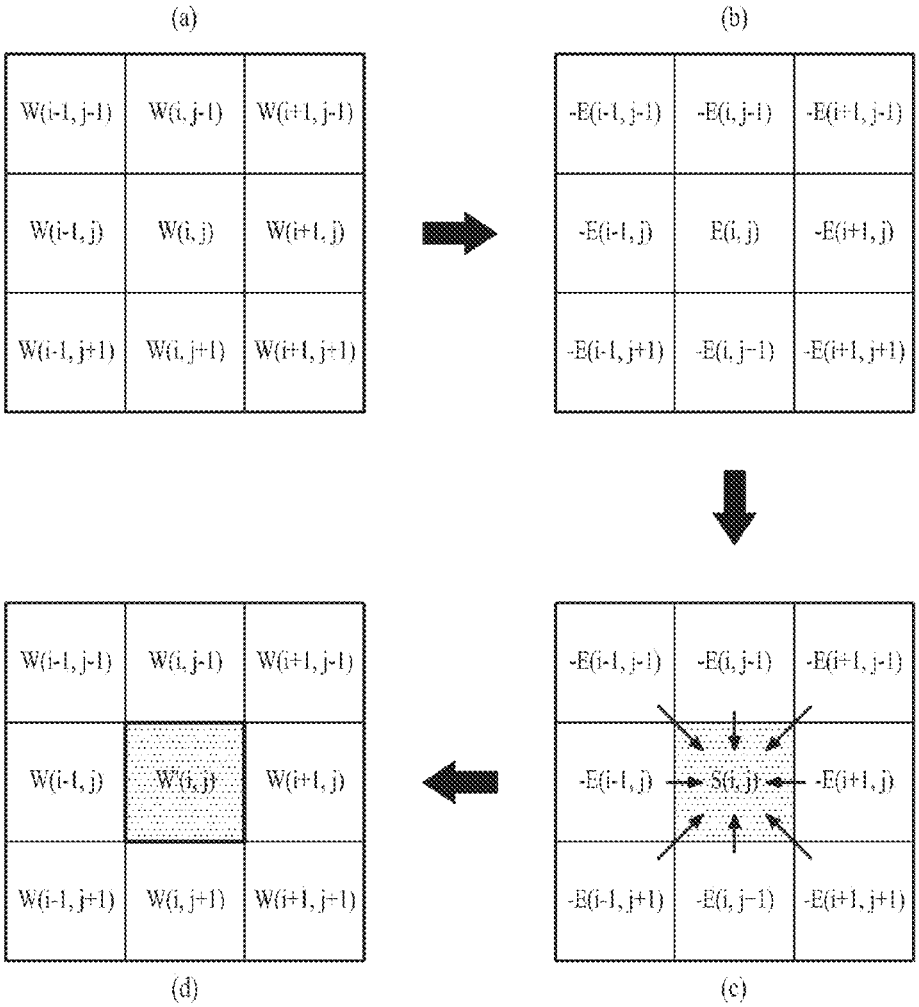
FIG. 5 illustrates a process for correcting sharpness by the sharpness enhancer, according to one embodiment.

FIG. 3 is a block diagram illustrating the sharpness enhancer shown in FIG. 2. FIG. 4 is a cross sectional view illustrating a sharpness correction mask used for the sharpness enhancer shown in FIG. 2. FIG. 5 illustrates a process for correcting the sharpness by the sharpness enhancer according to one embodiment.

Referring to FIGS. 3 to 5, the sharpness enhancer 30 according to one embodiment may include a memory 32 and an edge corrector 34.

The memory 32 stores the 4-color data (R, G, B, W) for each unit pixel supplied from the 4-color data generator 10 as a unit of frame.

The edge corrector 34 shifts the sharpness correction mask (SM) by each unit pixel based on the white data (W) for each unit pixel stored in the memory 32; and corrects the white data of the unit pixel corresponding to the center of the sharpness correction mask (SM), to enhance the sharpness of edge portion.

The sharpness correction mask (SM) is used to correct the white data (W) of the unit pixel corresponding to the center of mask by using white data (W) of the unit pixels included in the mask. The sharpness correction mask (SM) is provided with mask cells of 3×3 matrix configuration, wherein an edge correction coefficient based on prior experiments is preset in each of the mask cells. In case of the sharpness correction mask (SM) according to one example, the edge correction coefficient (k(i, j)) set in the central mask cell of the sharpness correction mask (SM) may have a positive (+) value, and the edge correction coefficients (−k(i−1, j−1), −k(i, j−1), −k(i+1, j−1), −k(i−1, j), −k(i+1, j), −k(i−1, j+1), −k(i, j+1), −k(i+1, j+1)) set in the circumferential mask cells except the central mask cell may have a negative (−) value. In this case, the edge correction coefficients (−k(i, j−1), −k(i, j+1), −k(i−1, j), −k(i+1, j)) identically set in the left/right/upper/lower-sided mask cells being adjacent to the central mask cell among the circumferential mask cells may be smaller than the edge correction coefficients (−k(i−1, j−1), −k(i+1, j−1), −k(i−1, j+1), −k(i+1, j+1)) identically set in the corner mask cells among the circumferential mask cells.

FIG. 4 illustrates the sharpness correction mask (SM) of 3×3 matrix configuration, but not limited to this structure. The size of sharpness correction mask (SM) and the edge correction coefficients set in the respective mask cells may vary according to a resolution of display panel, a logic size or a sharpness correction condition such as sharpness correction accuracy.

An operation of the edge corrector 34 using the sharpness correction mask (SM) will be described in detail as follows.

First, according as the edge correction coefficient (−k(i−1, j−1), −k(i, j−1), −k(i+1, j−1), −k(i−1, j), k(i, j), −k(i+1, j), −k(i−1, j+1), −k(i, j+1), −k(i+1, j+1)) which is in one-to-one correspondence with the white data (W(i−1, j−1), W(i, j−1), W(i+1, j−1), W(i−1, j), W(i, j), W(i+1, j), W(i−1, j+1), W(i, j+1), W(i+1, j+1)) for each unit pixel included in the sharpness correction mask (SM) is calculated by convolution as shown in FIG. 4 and (a) of FIG. 5. It is possible to calculate an edge correction value (−E(i−1, j−1), −E(i, j−1), −E(i+1, j−1), −E(i−1, j), E(i, j), −E(i+1, j), −E(i−1, j+1), −E(i, j+1), −E(i+1, j+1)) for the white data (W) for each unit pixel included in the sharpness correction mask (SM) as shown in (b) of FIG. 5.

The edge corrector 34 calculates a sharpness correction value (S(i, j)) for the white data (W) of the unit pixel corresponding to the central mask cell of the sharpness correction mask (SM), as shown in (c) of FIG. 5, by adding the edge correction values (−E(i−1, j−1), −E(i, j−1), −E(i+1, j−1), −E(i−1, j), E(i, j), −E(i+1, j), −E(i−1, j+1), −E(i, j+1), −E(i+1, j+1)) of the respective unit pixels included in the sharpness correction mask (SM).

Then, the edge corrector 34 calculates white correction data (W') as shown in (d) of FIG. 5, by adding the sharpness correction value (S(i, j)) and the white data (W(i, j)) of the unit pixel corresponding to the central mask cell of the sharpness correction mask (SM) shown in (a) and (c) of FIG. 5.

The edge corrector 34 updates the white data (W(i, j)) of the unit pixel corresponding to the central mask cell of the sharpness correction mask (SM) to the white correction data (W') in the memory 32.

The edge corrector 34 shifts the sharpness correction mask (SM) as a unit of each unit pixel; generates the aforementioned edge correction value, sharpness correction value and white correction data (W') on the basis of white data (W) of each unit pixel included in the shifted sharpness correction mask (SM); and updates the white data of the unit pixel corresponding to the central mask cell of the shifted sharpness correction mask (SM) to the white correction data (W') in the memory 32. The edge corrector 34 shifts the sharpness correction mask (SM) by each unit pixel, and performs the aforementioned process repetitively, so that it is possible to enhance the sharpness of input video frame by correcting the white data of the unit pixels corresponding to the edge portion of the input video frame stored in the memory 32.

Figures 6, 7:
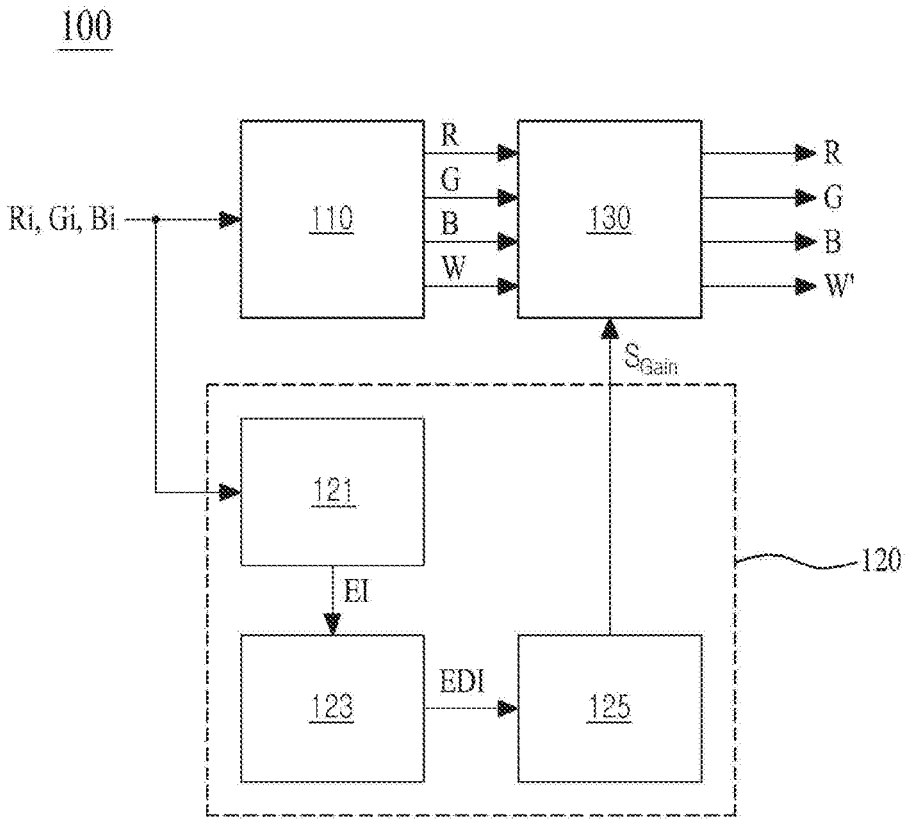
FIG. 6 is a block diagram illustrating an apparatus for converting data, according to one embodiment.
FIG. 7 illustrates an edge intensity detection mask used in an edge intensity calculator shown in FIG. 6.
Figure 8:
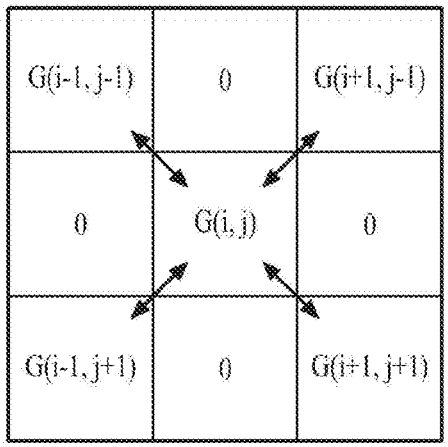
FIG. 8 illustrates a method for calculating an edge intensity of unit pixel in an edge intensity calculator shown in FIG. 6.
Figure 9:
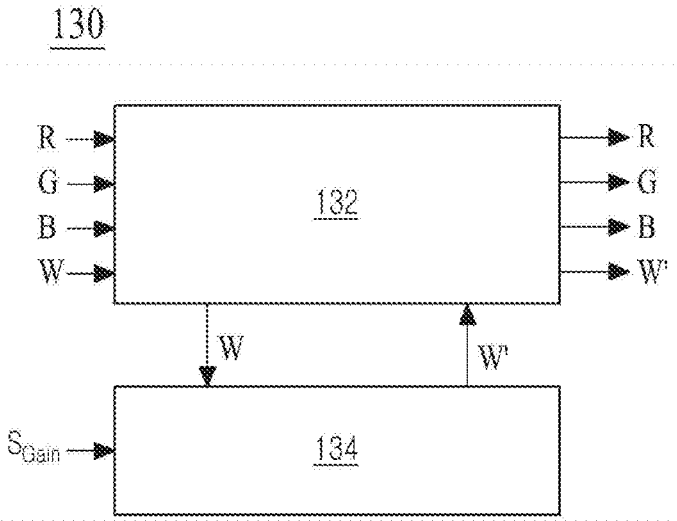
FIG. 9 is a block diagram illustrating a sharpness enhancer shown in FIG. 6.

FIG. 6 is a block diagram illustrating a data conversion apparatus according to one embodiment. FIG. 7 illustrates an edge intensity detection mask used in an edge intensity calculator shown in FIG. 6. FIG. 8 illustrates a method for calculating an edge intensity of unit pixel in an edge intensity calculator shown in FIG. 6. FIG. 9 is a block diagram illustrating a sharpness enhancer shown in FIG. 6.

Referring to FIGS. 6 to 9, the data conversion apparatus 100 according to one embodiment generates a sharpness gain value ($S_{Gain}$) and 4-color data (R, G, B, W) of red, green, blue and white colors for each unit pixel comprising red, green, blue and white sub-pixels on the basis of 3-color input data (Ri, Gi, Bi) of input video frame which is input as a unit of frame; and corrects white data of unit pixel corresponding to an edge portion by a luminance variation of adjacent unit pixels on the basis of white data (W) for each unit pixel and the sharpness gain value ($S_{Gain}$). To this end, the data conversion apparatus 100 according to this embodiment may include a 4-color data generator 110, a sharpness gain value generator 120 and a sharpness enhancer 130.

The 4-color data generator 110 generates the 4-color data of red, green, blue and white colors (R, G, B, W) for each unit pixel comprising the red, green, blue and white sub-pixels on the basis of 3-color input data (Ri, Gi, Bi) of an input video frame which is input as a unit of frame. The 4-color data generator 110 shown in FIG. 6 is identical in structure to the 4-color data generator 10 shown in FIG. 2.

The sharpness gain value generator 120 calculates an edge intensity (EI) for each unit pixel on the basis of 3-color input data (Ri, Gi, Bi) of the input video frame which is input as a unit of frame; calculates an edge distribution index (EDI) of the corresponding input video frame based on a rate of the number of unit pixels whose edge intensity (EI) is more than a reference edge intensity in a total number of unit pixels, and a ratio of the number of unit pixels with strong edge intensity to the number of unit pixels with weak edge intensity on the basis of edge intensity (EI) for each unit pixel and a total number of the entire unit pixels; and generates the sharpness gain value ($S_{Gain}$) according to the calculated edge distribution index (EDI). To this end, the sharpness gain value generator 120 may include an edge intensity calculator 121, an edge distribution index calculator 123 and a gain value calculator 125.

The edge intensity calculator 121 stores the 3-color input data (Ri, Gi, Bi) of the input video frame which is input as a unit of frame; and calculates the edge intensity (EI) for each unit pixel on the basis of 3-color input data (Ri, Gi, Bi) for each unit pixel. In detail, the edge intensity calculator 121 calculates a representative value for each unit pixel on the basis of grayscale value of input data (Ri, Gi, Bi) of red, green and blue colors for each unit pixel; shifts an edge intensity detection mask (EIM) by every unit pixel, and calculates an edge intensity correction value for each unit pixel included in the edge intensity detection mask (EIM) on the basis of representative value for each unit pixel included in the edge intensity detection mask (EIM); and calculates the edge intensity (EI) for each unit pixel corresponding to the center of the edge intensity detection mask (EIM) by adding the edge intensity correction values of the respective unit pixels.

The representative value for each unit pixel may be an average grayscale value of the input data (Ri, Gi, Bi) of red, green and blue colors.

The edge intensity detection mask (EIM) is used to correct the edge intensity (EI) of the unit pixel corresponding to the center of the mask in accordance with the average grayscale value of the unit pixels included in the mask. The edge intensity detection mask (EIM) is provided with the mask cells of 3×3 matrix configuration, wherein an edge intensity detection coefficient based on prior experiments is preset in each of the mask cells. For example, the edge intensity detection coefficient set in the central mask cell of the edge intensity detection mask (EIM) may have a value of '1', the edge intensity detection coefficient set in each corner mask cell positioned in a diagonal direction of the central mask cell may have a value of '−1/4', and the edge intensity detection coefficient set in the left/right/upper/lower-sided mask cells being adjacent to the central mask cell may have a value of '0'. In order to prevent picture quality from being deteriorated by the excessive sharpness enhancement for the image including the locally strong edges, the edge intensity detection coefficient of the left/right/upper/lower-sided mask cells being adjacent to the central mask is set to '0', and the edge intensity detection coefficient of each corner mask cell is set to '−1/4'.

An operation of the edge intensity calculator 121 using the edge intensity detection mask (EIM) will be described in detail as follows.

First, the edge intensity calculator 121 calculates the edge intensity correction value for each unit pixel included in the edge intensity detection mask (EIM) through a convolution calculation of the edge intensity detection coefficient of the mask cell being in a one-to-one correspondence with the representative value for each unit pixel included in the edge intensity detection mask (EIM).

Thereafter, the edge intensity calculator 121 calculates the edge intensity ($EI_{G(i,j)}$) of the unit pixel corresponding to the central mask cell of the edge intensity detection mask (EIM) by adding the edge intensity correction value for each unit pixel included in the edge intensity detection mask (EIM) shown in FIG. 8 by equation (1).

$$EI_{G(i,j)} = \frac{|G(i,j) - G(i-1,j-1)| + |G(i,j) - G(i+1,j-1)| + |G(i,j) - G(i-1,j+1)| + |G(i,j) - G(i+1,j+1)|}{4} \quad (1)$$

That is, the edge intensity ($EI_{G(i,\ j)}$) of the unit pixel corresponding to the central mask cell of the edge intensity detection mask (EIM) may be calculated by dividing a result value, which is made by adding each absolute value obtained by subtracting the edge intensity correction value of each corner unit pixel (G(i−1, j−1), G(i+1, j−1), G(i−1, j+1), G(i+1, j+1)) corresponding to each corner mask cell of the edge intensity detection mask (EIM) from the edge intensity correction value of the central unit pixel (G(i, j)) corresponding to the central mask cell of the edge intensity detection mask (EIM), by four through the above equation (1).

The edge distribution index calculator 123 calculates the edge distribution index (EDI) for the corresponding input video frame on the basis of edge intensity (EI) for each unit pixel provided from the edge intensity calculator 121 through equation (2).

$$EDI = \frac{SUM2}{SUM1} \times \frac{SUM3}{Tpixel} \tag{2}$$

In the above equation (2), 'SUM2/SUM1' corresponds to the ratio of the number of unit pixels with strong edge intensity to the number of unit pixels with weak edge intensity in the input video frame, where 'SUM1' is the number of unit pixels with strong edge intensity (the number of unit pixels whose edge intensity (EI) is more than a reference weak edge intensity in the input video frame), and 'SUM2' is the number of unit pixels with weak edge intensity (the number of unit pixels whose edge intensity (EI) is more than a minimum edge intensity and is less than the reference weak edge intensity in the input video frame). 'SUM3/Tpixel' is a rate of the number of unit pixels whose edge intensity (EI) is more than the reference edge intensity in the total number of unit pixels, where 'SUM3' is the number of unit pixels whose edge intensity (EI) is more than the reference edge intensity in the input video frame, and 'Tpixel' is the total number of unit pixels for displaying the input video frame.

The edge distribution index calculator 123 receives the edge intensity (EI) for each unit pixel from the edge intensity calculator 121; calculates the number (SUM1) of unit pixels with strong edge intensity, the number (SUM2) of unit pixels with weak edge intensity and the number (SUM3) of unit pixels whose edge intensity (EI) is more than the reference edge intensity by comparing the received edge intensity (EI) for each unit pixel with each of the reference weak edge intensity, the minimum edge intensity and the reference edge intensity, and counting the number of corresponding unit pixels based on the comparison result; and calculates the edge distribution index (EDI) for the input video frame through the calculation of the above equation (2). As the number of unit pixels with strong edge intensity is further increased, the edge distribution index (EDI) is further decreased. Meanwhile, as the number of unit pixels with strong edge intensity is further decreased, the edge distribution index (EDI) is further increased.

The gain value calculator 125 calculates the sharpness gain value ($S_{Gain}$) of the corresponding input video frame on the basis of edge distribution index (EDI) of the input video frame provided from the edge distribution index calculator 123. In detail, the gain value calculator 125 may compare a preset edge distribution index threshold value with the edge distribution index (EDI), and calculate the sharpness gain value ($S_{Gain}$) through the use of initially-set gain value in accordance with the comparison result; or may calculate a result value obtained by dividing the edge distribution index (EDI) by the edge distribution index threshold value, calculates an exponentiation value through the use exponentiation with a preset index value (Gainexp) for the result value, and calculates the sharpness gain value ($S_{Gain}$) by multiplying the initially-set gain value and the exponentiation value. For example, if the edge distribution index (EDI) is larger than the preset edge distribution index threshold value, the gain value calculator 125 determines that the corresponding input video frame is the image with weak sharpness (image with many weak edge components), whereby the sharpness gain value ($S_{Gain}$) is calculated using the initially-set gain value, and thus the picture quality of image is improved by enhancing the sharpness. In this case, the sharpness gain value ($S_{Gain}$) is a constant value corresponding to the initially-set gain value without regard to the edge distribution index (EDI).

In another example, if the edge distribution index (EDI) is the same as or smaller than the preset edge distribution index threshold value, the gain value calculator 125 determines that the corresponding input video frame is the image with strong sharpness (image with many strong edge components), whereby the sharpness gain value ($S_{Gain}$) is calculated by the following equation (3), and thus the image is maintained without chaining the sharpness so as to realize the good sharpness of image, thereby preventing the picture quality from being deteriorated by the excessive sharpness enhancement. In this case, the sharpness gain value ($S_{Gain}$) is calculated using the constant value in which the initially-set gain value is exponentially lowered according as the edge distribution index (EDI) is lowered.

$$S_{Gain} = G_{Initial} \times \left(\frac{EDI}{TH_{EDI}}\right)^{Gain\ exp} \tag{3}$$

In the above equation (3), '$S_{Gain}$' is the sharpness gain value, '$G_{Initial}$' is the initially-set gain value, 'EDI' is the edge distribution index, and '$TH_{EDI}$' is the edge distribution index threshold value. Also, the index value (Gainexp) may be the constant value preset based on the edge distribution indexes (EDI) obtained by prior experiments for general and pattern images.

As shown in the above equation (2), the edge distribution index calculator 123 may calculate the edge distribution index (EDI) for the input image through the calculation of ratio (SUM2/SUM1) between the number of unit pixels with strong edge intensity and the number of unit pixels with weak edge intensity in the input image of one frame. However, in case of an image including a lot of locally-strong edge components, the edge distribution index (EDI) may be relatively higher. In this case, the sharpness gain value ($S_{Gain}$) is raised due to the high edge distribution index (EDI), whereby a color distortion may occur by the sharpness enhancement. Accordingly, when the image includes the locally-strong edge components, the edge distribution index calculator 123 lowers the edge distribution index (EDI), and thus lowers the sharpness gain value ($S_{Gain}$), whereby the edge distribution index (EDI) is calculated through the above equation (2) without color distortion caused by the excessive sharpness enhancement, preferably.

The sharpness enhancer 130 corrects the white data (W) of the unit pixel corresponding to the edge portion by the luminance variation of adjacent unit pixels on the basis of white data (W) for each unit pixel supplied as a unit of frame from the 4-color data generator 110 and the sharpness gain value ($S_{Gain}$) supplied as a unit of frame from the sharpness gain value generator 120, to thereby enhance the sharpness of the input image. That is, the sharpness enhancer 130 shifts the mask as a unit of each unit pixel on the basis of sharpness gain value ($S_{Gain}$) and white data (W) for each unit pixel, and corrects the white data (W) for each unit pixel corresponding to the center of the mask, thereby enhancing the sharpness of the edge portion. Then, the 4-color data (R, G, B, W') of red, green, blue and white colors for each unit pixel, in which the sharpness of edge portion is enhanced as a unit of frame by the sharpness enhancer 30, is transmitted to the panel driver of the display apparatus in accordance with a predetermined data interface method. To this end, as shown in FIG. 9, the sharpness enhancer 130 may include a memory 132 and an edge corrector 134.

The memory 132 stores the 4-color data (R, G, B, W) for each unit pixel supplied from the 4-color data generator 110 as a unit of frame.

The edge corrector 134 shifts the sharpness correction mask (SM) as a unit of each unit pixel based on the white data (W) for each unit pixel stored in the memory 132 and the sharpness gain value ($S_{Gain}$) supplied from the sharpness gain value generator 120 as a unit of frame; and corrects the white data of the unit pixel corresponding to the center of the sharpness correction mask (SM), to thereby enhance the sharpness of edge portion. An operation of the edge corrector 134 will be described in detail as follows.

Figure 10:
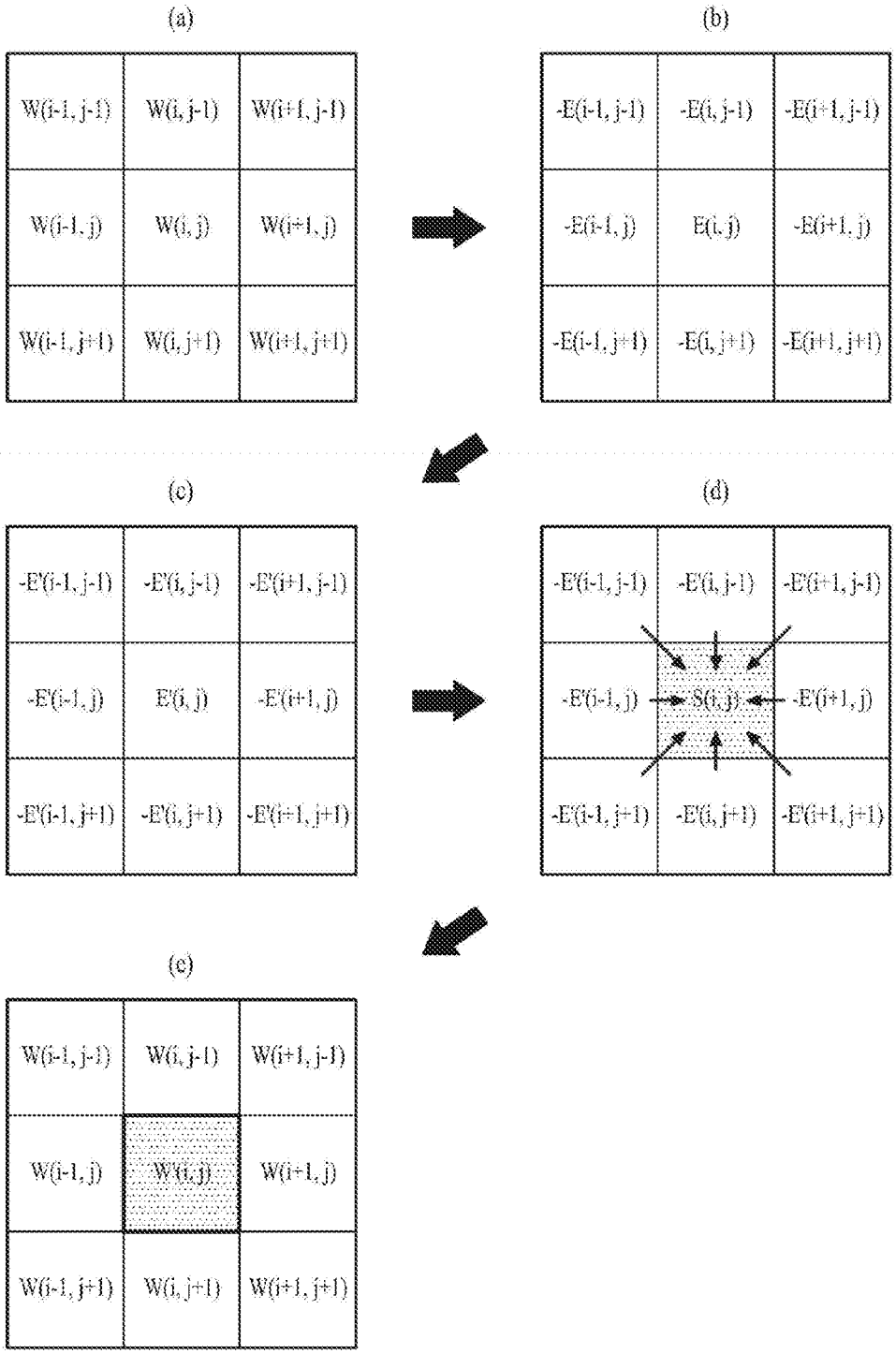
FIG. 10 illustrates a process for correcting sharpness in a sharpness enhancer, according to one embodiment.

First, as shown in FIG. 4 and (a) of FIG. 10, according as edge correction coefficient (−k(i−1, j−1), −k(i, j−1), −k(i+1, j−1), −k(i−1, j), k(i, j), −k(i+1, j), −k(i−1, j+1), −k(i, j+1), −k(i+1, j+1)) which is in one-to-one correspondence with the white data (W(i−1, j−1), W(i, j−1), W(i+1, j−1), W(i−1, j), W(i, j), W(i+1, j), W(i−1, j+1), W(i, j+1), W(i+1, j+1)) for each unit pixel included in the sharpness correction mask (SM) is calculated by convolution in the edge corrector 134. It is possible to calculate an edge correction value (−E(i−1, j−1), −E(i, j−1), −E(i+1, j−1), −E(i−1, j), E(i, j), −E(i+1, j), −E(i−1, j+1), −E(i, j+1), −E(i+1, j+1)) for the white data (W) for each unit pixel included in the sharpness correction mask (SM), as shown in (b) of FIG. 10.

Then, the edge corrector 134 calculates edge correction value (−E'(i−1, j−1), −E'(i, j−1), −E'(i+1, j−1), −E'(i−1, j), E'(i, j), −E'(i+1, j), −E'(i−1, j+1), −E'(i, j+1), −E'(i+1, j+1)) for each unit pixel, to which the sharpness gain value ($S_{Gain}$) is applied, as shown in (c) of FIG. 10, by multiplying the sharpness gain value ($S_{Gain}$) and the edge correction value (−E(i−1, j−1), −E(i, j−1), −E(i+1, j−1), −E(i−1, j), E(i, j), −E(i+1, j), −E(i−1, j+1), −E(i, j+1), −E(i+1, j+1)) for each unit pixel included in the sharpness correction mask (SM).

Then, the edge corrector 134 calculate sharpness correction value (S(i, j)) for the white data (W) of the unit pixel corresponding to the central mask cell of the sharpness correction mask (SM), as shown in (d) of FIG. 10, by adding the edge correction value (−E'(i−1, j−1), −E'(i, j−1), −E'(i+1, j−1), −E'(i−1, j), E'(i, j), j), −E'(i−1, j+1), −E'(i, j+1), −E'(i+1, j+1)) for each unit pixel, to which the sharpness gain value ($S_{Gain}$) is applied.

Then, the edge corrector 134 calculates white correction data (W') as shown in (e) of FIG. 10, by adding the sharpness correction value (S(i, j)) and the white data (W(i, j)) of the unit pixel corresponding to the central mask cell of the sharpness correction mask (SM) shown in (a) and (d) of FIG. 10.

The edge corrector 134 updates the white data (W(i, j)) of the unit pixel corresponding to the central mask cell of the sharpness correction mask (SM) to the white correction data (W') in the memory 132.

The edge corrector 134 shifts the sharpness correction mask (SM) as a unit of each unit pixel; generates the aforementioned edge correction value based on the white data (W) for each unit pixel included in the shifted sharpness correction mask (SM), the edge correction value to which the sharpness gain value ($S_{Gain}$) is applied, the sharpness correction value and the white data (W'); and updates the white data of the unit pixel corresponding to the central mask cell of the sharpness correction mask (SM), which is shifted in the memory 132, to the white correction data (W'). The edge corrector 134 shifts the sharpness correction mask (SM) by each unit pixel, and performs the aforementioned process repetitively, so that it is possible to enhance the sharpness of input video frame by correcting the white data of the unit pixels corresponding to the edge portion of the input video frame stored in the memory 132.

The data conversion apparatus 100 according to one embodiment of the present invention may further include a reverse-gamma corrector and a gamma corrector.

The data conversion apparatuses 1 and 100 according to the embodiments of the present invention may convert the RGB 3-color data into the RGBW 4-color data, and correct the white data (W) of the edge portion for the input image on the basis of white data (W), to thereby enhance the sharpness without deteriorating the picture quality of image. Especially, the data conversion apparatuses 1 and 100 may simplify the sharpness enhancement process for the input image by omitting the steps for converting the RGB 3-color data into luminance components and re-converting the luminance components into the RGB 3-color data.

Figure 11:
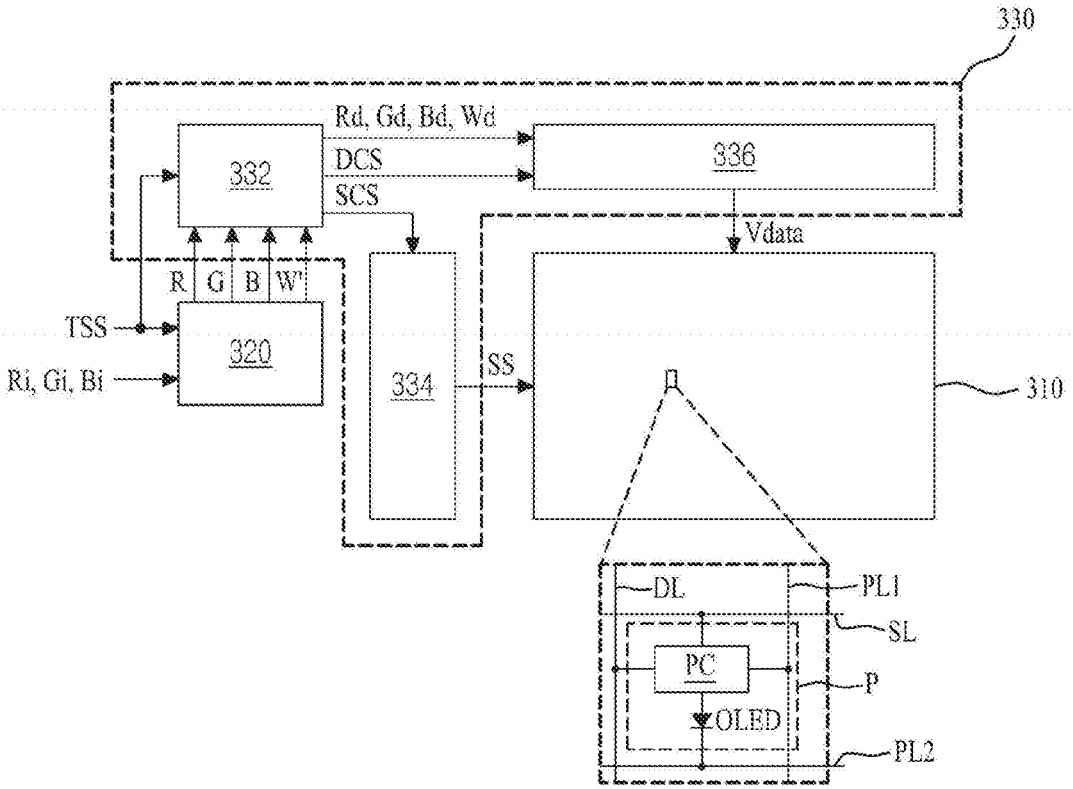
FIG. 11 is a block diagram illustrating a display apparatus, according to one embodiment.

FIG. 11 is a block diagram illustrating the display apparatus according to the embodiment of the present invention.

Referring to FIG. 11, the display apparatus according to the embodiment of the present invention may include a display panel 310, a data converter 320 and a panel driver 330.

The display panel 310 is provided with red, green, blue and white sub-pixels (P) constituting each unit pixel, wherein an organic light emitting diode (OLED) in each of red, green, blue and white sub-pixels (P) constituting each unit pixel emits light, whereby an image is displayed on the display panel 310 through the light emitted from each unit pixel. The display panel 310 may include a plurality of data lines (DL) and scan lines (SL), wherein the data line is perpendicular to the scan line (SL) so as to define a pixel region, a plurality of first power lines (PL1) formed in parallel with the plurality of data lines (DL), and a plurality of second power lines (PL2) formed in perpendicular to the plurality of first power lines (PL1).

The plurality of data lines (DL) are formed at fixed intervals along a first direction, and the plurality of scan lines (SL) are formed at fixed intervals along a second direction which is perpendicular to the first direction. The first power line (PL1) is formed in parallel with the plurality of data lines (DL) and provided adjacent to each of the data lines (DL), and the first power line (PL1) is supplied with a first driving power from the external.

Each of the second power lines (PL2) is perpendicular to each of the first power lines (PL1), and the second power line (PL2) is supplied with a second driving power from the external. The second driving power may be a low-potential voltage level which is lower than the first driving power, or a ground voltage level.

The display panel 310 may include a common cathode electrode instead of the plurality of second power lines (PL2). The common cathode electrode is formed on an entire display area of the display panel 310, and the common cathode electrode is supplied with the second driving power from the external.

The sub-pixel (P) may include the organic light emitting diode (OLED), and a pixel circuit (PC).

The organic light emitting diode (OLED) is connected between the pixel circuit (PC) and the second power line (PL2). The organic light emitting diode (OLED) emits light in proportion to an amount of data current supplied from the pixel circuit (PC), to emit light with a predetermined color. To this end, the organic light emitting diode (OLED) may include an anode electrode (or pixel electrode) connected to the pixel circuit (PC), a cathode electrode (or reflective electrode) connected to the second driving power line (PL2), and an organic light emitting cell formed between the anode and cathode electrodes, wherein the organic light emitting cell emits light with any one among red, green, blue and white colors. The organic light emitting cell may be formed in a deposition structure of hole transport layer/organic light emitting layer/electron transport layer or a deposition structure of hole injection layer/hole transport layer/organic light emitting layer/electron transport layer/electron injection layer. Furthermore, the organic light emitting cell may include a functional layer for improving light-emitting efficiency and/or lifespan of the organic light emitting layer.

The pixel circuit (PC) makes a data current corresponding to a data voltage (Vdata) supplied from the panel driver 330 to the data line (DL) flow in the organic light emitting diode (OLED) in response to a scan signal (SS) supplied from the panel driver 330 to the scan line (SL). The pixel circuit (PC) may include a switching transistor, a driving transistor and at least one capacitor, which are formed on a substrate for a process for forming a thin film transistor.

The switching transistor is switched by the scan signal (SS) supplied to the scan line (SL), whereby the switching transistor supplies the data voltage (Vdata), which is supplied from the data line (DL), to the driving transistor. The driving transistor is switched by the data voltage (Vdata) supplied from the switching transistor, whereby the driving transistor generates the data current based on the data voltage (Vdata), and supplies the generated data current to the organic light emitting diode (OLED), to thereby make the organic light emitting diode (OLED) emit light in proportion to the amount of data current. At least one capacitor maintains the data voltage supplied to the driving transistor for one frame.

In the pixel circuit (PC) for each sub-pixel (P), a threshold voltage variation of the driving transistor occurs in accordance with a driving time of the driving transistor, and causes deterioration of picture quality. Accordingly, the organic light emitting display apparatus may further include a compensation circuit (not shown) to compensate for a threshold voltage of the driving transistor.

The compensation circuit may include at least one compensation transistor (not shown) and at least one compensation capacitor (not shown) provided inside the pixel circuit (PC). The compensation circuit compensates for the threshold voltage of each driving transistor (T2) by storing the threshold voltage of the driving transistor (T2) and the data voltage for a detection period of detecting the threshold voltage of the driving transistor (T2) in the capacitor.

The data converter 320 generates the 4-color data (R, G, B, W) of red, green, blue and white colors for each unit pixel comprising red, green, blue and white sub-pixels on the basis of 3-color input data (Ri, Gi, Bi) of input video frame which is input as a unit of frame from an external system body (not shown) or graphic card (not shown); and enhances sharpness of the input video frame by correcting white data of the unit pixel corresponding to the edge portion by the luminance variation of the adjacent unit pixels on the basis of the white data (W) for each unit pixel. The data converter 320 comprises the first or second data conversion apparatus 1 or 100 described with reference to FIGS. 2 to 10.

The panel driver 330 generates a scan control signal and a data control signal on the basis of timing synchronized signal (TSS); generates the scan signal in accordance with the scan control signal, and sequentially supplies the generated scan signal to the scan line (SL); and converts the 4-color data (R, G, B, W') supplied from the data converter 320 into the data voltage (Vdata), and supplies the data voltage (Vdata) to the data line (DL). The panel driver 330 may include a timing controller 332, a scan driving circuit 334, and a data driving circuit 336.

The timing controller 332 controls a driving timing for each of the scan driving circuit 334 and the data driving circuit 336 in accordance with the timing synchronized signal (TSS) which is input from the external system body (not shown) or graphic card (not shown). That is, the timing controller 332 generates the scan control signal (SCS) and data control signal (DCS) on the basis of timing synchronized signal (TSS) such as vertically synchronized signal, horizontally synchronized signal, data enable signal, clock signal, etc.; and controls the driving timing of the scan driving circuit 334 through the scan control signal (SCS), and the driving timing of the data driving circuit 336 through the data control signal (DCS).

The timing controller 332 aligns the 4-color data (R, G, B, W') supplied from the data converter 320 so as to make the 4-color data (R, G, B, W') be appropriate for the driving of the display panel 310; and supplies the aligned 4-color display data (Rd, Gd, Bd, Wd) of red, green, blue and white colors to the data driving circuit 336 through the preset data interface method.

The data converter 320 may be provided in the timing controller 332. In this case, the data converter 320 of a program type may be formed in the timing controller 332.

The scan driving circuit 334 generates the scan signal (SS) in accordance with the scan control signal (SCS) supplied from the timing controller 332, and sequentially supplies the scan signal (SS) to the plurality of scan lines (SL).

The data driving circuit 336 is supplied with the data control signal (DCS) and the 4-color display data ((Rd, Gd, Bd, Wd) aligned by the timing controller 332, and is also supplied with a plurality of reference gamma voltages from an external power supplier (not shown). The data driving circuit 336 converts the 4-color display data (Rd, Gd, Bd, Wd) into the analog-type data voltage (Vdata) by the plurality of reference gamma voltages in accordance with the data control signal (DCS), and supplies the data voltage to the corresponding data line (DL).

As mentioned above, the data conversion apparatuses 1 and 100 according to the various embodiments and the display apparatus using the same may convert the RGB 3-color data into the RGBW 4-color data; and correct the white data (W) of the edge portion of the input image on the basis of the white data (W), to enhance the sharpness without deterioration of picture quality. Especially, the data conversion apparatuses 1 and 100 according to the various embodiments may simplify the process for enhancing the sharpness of the input image by omitting the steps for converting the RGB 3-color data into luminance components and re-converting the luminance components into the RGB 3-color data.

In the above display apparatus according to the embodiment of the present invention, each sub-pixel (P) includes the organic light emitting diode (OLED) and the pixel circuit (PC), but not limited to this structure. For example, each sub-pixel (P) may be formed of a liquid crystal cell. The display apparatus according to the various embodiments may be an organic light emitting display apparatus or a liquid crystal display apparatus.

Figure 12:
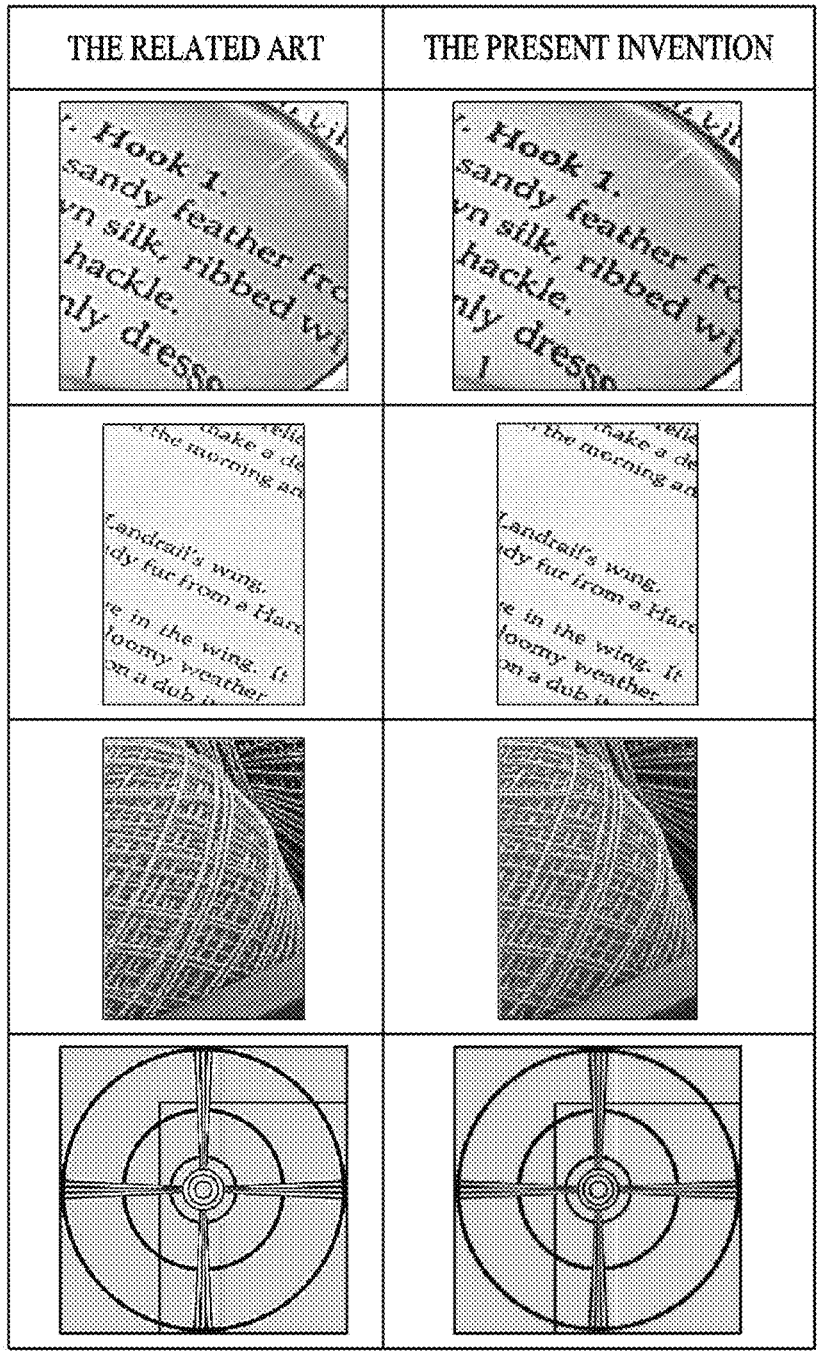
FIG. 12 illustrates an image displayed by a data conversion method according to the related art, and an image displayed by a data conversion method according to the present invention.

FIG. 12 illustrates an image displayed by a data conversion method according to the related art, and an image displayed by a data conversion method according to the present invention.

Referring to FIG. 12, in case of the image displayed by the data conversion method according to the related art, since RGB 3-color data is converted into luminance components, and the luminance components are re-converted into the RGB 3-color data, the luminance change of edge portion makes the change of RGB 3-color data of unit pixel so that the edge portion looks white, that is, a ringing artifact occurs. Also, a white edge is shown in the edge portion of letter-pattern image or line-pattern image.

In case of the image displayed by the data conversion method according to the present invention, RGB 3-color data is converted into RGBW 4-color without changing luminance components of the RGB 3-color data, and white data (W) for an edge portion for an input image is corrected based on white data (W), whereby an ringing artifact is removed, and thus sharpness is enhanced. Especially, even in case of a line-pattern image with a lot of locally-strong edge components, it is possible to enhance sharpness without color distortion by applying the sharpness gain value in accordance with the edge distribution index.

According to the present invention, the RGB 3-color data is converted into the RGBW 4-color data, and the white data for the edge portion of the input image is corrected based on the white data for each unit pixel so that it is possible to enhance the sharpness without deterioration of picture quality.

Also, the sharpness of input image is enhanced by applying the sharpness gain value in accordance with the edge distribution index of input image on the basis of edge intensity for each unit pixel. Thus, even in case of image with a lot of locally-strong edge components, it is possible to enhance the sharpness without color distortion.

Also, the sharpness enhancement process for the input image is simplified by omitting the steps of converting the RGB 3-color data into the luminance components and re-converting the luminance components into the RGB 3-color data.

It will be apparent to those skilled in the art that various modifications and variations can be made without departing from the spirit or scope of the inventions. Thus, it is intended that the present invention covers the modifications and variations of this invention provided they come within the scope of the appended claims and their equivalents.

What is claimed is:

1. An apparatus for converting data in a display apparatus including a plurality of unit pixels, each unit pixel with red, green, blue and white sub-pixels, the apparatus comprising:

a 4-color data generator for generating 4-color data of red, green, blue and white colors for each unit pixel based on a 3-color input data of red, green and blue colors of an input image;

a sharpness gain value generator for calculating a sharpness gain value for the input image based on an edge intensity for each unit pixel in accordance with the 3-color data of each unit pixel; and a sharpness enhancer for enhancing sharpness of the input image by correcting white sub-pixel data of a unit pixel of the plurality of unit pixels, the unit pixel corresponding to an edge portion of the input image, by a luminance variation of adjacent unit pixels based on the white sub-pixel data for each unit pixel and the sharpness gain value, wherein the sharpness gain value generator calculates an edge distribution index by multiplying a ratio of a number of unit pixels whose edge intensity is more than a reference weak edge intensity and a number of unit pixels whose edge intensity is more than a minimum edge intensity and less than the reference weak edge intensity, and a rate of a number of unit pixels whose energy intensity is more than a reference edge intensity in a total number of unit pixels, and calculates the sharpness gain value in accordance with the calculated edge distribution index.

2. The apparatus of claim 1, wherein the sharpness enhancer shifts a matrix-configuration mask by each unit pixel, and corrects white sub-pixel data of each unit pixel corresponding to a central mask cell of the matrix-configuration mask to enhance sharpness of the edge portion of the input image.

3. The apparatus of claim 2, wherein the sharpness enhancer enhances the sharpness of edge portion by:

calculating an edge correction value for each unit pixel included in the matrix-configuration mask through a convolution calculation of an edge correction coefficient set in each mask cell of the matrix-configuration mask and the white sub-pixel data of each unit pixel included in the matrix-configuration mask;

multiplying the sharpness gain value and the edge correction value for each unit pixel included in the matrix-configuration mask;

calculating a sharpness correction value by adding the edge correction values for respective unit pixels included in the matrix-configuration mask, wherein each edge correction value is obtained by applying the sharpness gain value thereto; and correcting the white sub-pixel data of the unit pixel corresponding to the central mask cell of the matrix-configuration mask in accordance with the calculated sharpness correction value.

4. The apparatus of claim 3, wherein the edge correction coefficient set in the central mask cell of the matrix-configuration mask has a positive (+) value, and the edge correction coefficient set in remaining circumferential mask cells of the matrix-configuration mask except the central mask cell has a negative (−) value.

5. The apparatus of claim 4, wherein the edge correction coefficient set in each corner mask cell among the circumferential mask cells of the mask has a negative (−) value, and wherein the edge correction coefficient set in each of the left, right, upper, and lower-sided mask cells being adjacent to the central mask cell among the circumferential mask cells of the matrix-configuration mask have a negative (−) value, and the edge correction coefficient thereof is smaller than the edge correction coefficient set in each corner mask cell.

6. The apparatus of claim 1, wherein the sharpness gain value generator includes a gain value calculator for generating the sharpness gain value in accordance with the calculated edge distribution index, wherein the gain value calculator compares the edge distribution index with a preset edge distribution index threshold value, and calculates the sharpness gain value based on the comparison, wherein, if the edge distribution index is larger than the edge distribution index threshold value, the sharpness gain value is an initially-set gain value, and wherein, if the edge distribution index is the same as or smaller than the edge distribution index threshold value, the sharpness gain value is calculated by calculating a first value obtained by dividing the edge distribution index by the edge distribution index threshold value, calculating a second value through the use of exponentiation with a preset index value for the first value, and multiplying the initially-set gain value and the second value.

7. A display apparatus comprising:

a display panel including a plurality of unit pixels, each unit pixel with red, green, blue and white sub-pixels, formed in a pixel region defined by a plurality of data lines and scan lines, the data lines crossing the scan lines;

a data converter including a 4-color data generator for generating 4-color data of red, green, blue and white colors for each unit pixel based on 3-color input data of red, green and blue colors of an input image, a sharpness gain value generator for calculating a sharpness gain value for the input image based on an edge intensity for each unit pixel in accordance with the 3-color data of each unit pixel, and a sharpness enhancer for enhancing sharpness of the input image by correcting white sub-pixel data of the unit pixel corresponding to an edge portion of the input image by a luminance variation of adjacent unit pixels based on the white sub-pixel data for each unit pixel and the sharpness gain value; and a panel driver for supplying a scan signal to the scan line, converting the 4-color data supplied from the data converter into a data voltage, and supplying the data voltage to the data line, wherein the sharpness gain value generator calculates an edge distribution index by multiplying a ratio of a number of unit pixels whose edge intensity is more than a reference weak edge intensity and a number of unit pixels whose edge intensity is more than a minimum edge intensity and less than the reference weak edge intensity, and a rate of a number of unit pixels whose energy intensity is more than a reference edge intensity in a total number of unit pixels, and calculates the sharpness gain value in accordance with the calculated edge distribution index.

8. The display apparatus of claim 7, wherein the sharpness enhancer shifts a matrix-configuration mask by each unit pixel, and corrects white data of each unit pixel corresponding to a central mask cell of the matrix-configuration mask to enhance sharpness of the edge portion of the input image.

9. The display apparatus of claim 8, wherein the sharpness enhancer enhances the sharpness of edge portion by:

calculating an edge correction value for each unit pixel included in the matrix-configuration mask through a convolution calculation of an edge correction coefficient set in each mask cell of the matrix-configuration mask and the white sub-pixel data of each unit pixel included in the matrix-configuration mask;

multiplying the sharpness gain value and the edge correction value for each unit pixel included in the matrix-configuration mask;

calculating a sharpness correction value by adding the edge correction values for respective unit pixels included in the matrix-configuration mask, wherein each edge correction value is obtained by applying the sharpness gain value thereto; and correcting the white sub-pixel data of the unit pixel corresponding to the central mask cell of the matrix-configuration mask in accordance with the calculated sharpness correction value.

10. The display apparatus of claim 9, wherein the edge correction coefficient set in each corner mask cell among the circumferential mask cells of the mask has a negative (−) value, and wherein the edge correction coefficient set in each of the left, right, upper, and lower-sided mask cells being adjacent to the central mask cell among circumferential mask cells of the matrix-configuration mask have a negative (−) value, and the edge correction coefficient thereof is smaller than the edge correction coefficient set in each corner mask cell.

11. The display apparatus of claim 7, wherein the sharpness gain value generator includes a gain value calculator for generating the sharpness gain value in accordance with the calculated edge distribution index, wherein the gain value calculator compares the edge distribution index with a preset edge distribution index threshold value, and calculates the sharpness gain value based on the comparison, wherein, if the edge distribution index is larger than the edge distribution index threshold value, the sharpness gain value is an initially-set gain value, and wherein, if the edge distribution index is the same as or smaller than the edge distribution index threshold value, the sharpness gain value is calculated by calculating a first value obtained by dividing the edge distribution index by the edge distribution index threshold value, calculating a second value through the use of exponentiation with a preset index value for the first value, and multiplying the initially-set gain value and the second value.

* * * * *